United States Patent [19]

Rhoades

[11] Patent Number: 4,493,200

[45] Date of Patent: Jan. 15, 1985

[54] PORTABLE SHEET BENDING BRAKE

[75] Inventor: James J. Rhoades, Garden City, Mich.

[73] Assignee: Tapco Products Company, Inc., Detroit, Mich.

[21] Appl. No.: 474,206

[22] Filed: Mar. 10, 1983

[51] Int. Cl.[3] ..... B21D 5/04

[52] U.S. Cl. ..... 72/319; 72/465

[58] Field of Search ..... 72/319–323, 72/388, 387, 312–315, 465, 466

[56] References Cited

U.S. PATENT DOCUMENTS

| | | | |
|---|---|---|---|
| 1,785,537 | 12/1930 | Stevens | 72/314 |
| 3,380,280 | 4/1968 | Wise | 72/319 |
| 3,482,427 | 12/1969 | Barnack | 72/319 |
| 3,808,867 | 5/1974 | Becker | 72/321 |
| 3,908,433 | 9/1975 | Helzer | 72/319 |
| 4,282,735 | 8/1981 | Break | 72/319 |

*Primary Examiner*—Daniel C. Crane

*Attorney, Agent, or Firm*—Barnes, Kisselle, Raisch, Choate, Whittemore & Hulbert

[57] ABSTRACT

A portable sheet bending brake comprising a first member defining a clamping surface extending longitudinally, a second member extending longitudinally and hinged to the fixed member, and an anvil member extending longitudinally of the sheet bending brake that is moved into and out of clamping position with the fixed member. A floating compensator comprising a compensator member is pivoted to the bending member and a workpiece engaging pad is pivoted to the compensator member such that as the bending member is swung to bend a workpiece, the pad engages the surface of the workpiece and remains in contact with the workpiece at the same area by the relative pivotal action of the bending member, the compensator member and the pad.

7 Claims, 5 Drawing Figures

42
41
49
S
38
37
45
48
26
40
46
27
47
43
44
24
20
28

PORTABLE SHEET BENDING BRAKE

This invention relates to sheet bending brakes and particularly to portable sheet bending brakes.

BACKGROUND AND SUMMARY OF THE INVENTION

In the handling of sheet material such as is used for building construction, it has been common in recent times to provide a portable sheet bending brake wherein sheet material is clamped between an anvil member and a clamping surface and a bending member is hinged for bending the sheet material about the anvil member. Typical sheet bending brakes are disclosed in U.S. Pat. Nos. 3,161,223, 3,481,174, 3,482,427, 3,559,444, 3,187,075 and 4,240,279.

As shown, for example, in the aforementioned U.S. Pat. Nos. 3,161,223, 3,559,444, 3,817,075 and 4,240,279, the anvil member is clamped into position by means of a backing plate that has inclined cams underlying a portion of the fixed frame so that when the plate is moved longitudinally by a hand lever, the cams are moved into and out of position clamping and unclamping the backing plate.

In the aforementioned U.S. Pat. Nos. 3,481,174 and 3,482,427, the anvil is supported by pivoted bars that, in turn, are connected by links to a handle that is pivoted on the frame of the brake so that rotation of the handle moves the bars and, in turn, the anvil into and out of clamping position.

It has also heretofore been suggested that eccentric cams be utilized for moving the anvil member into and out of position as shown, for example, in U.S. Pat. Nos. 3,383,899, 4,092,841 and 4,081,986.

In the aforementioned U.S. Pat. Nos. 3,481,174 and 3,482,427, a floating compensator has been pivoted on the bending member such that the compensator engages an area of the workpiece and remains in engagement with the same area so that the workpiece is not marred or scuffed during the bending. Such an arrangement has proved very effective in portable sheet bending brakes. However, as the bending member approaches and exceeds a position for making a bend of 90° or greater, the area of application of force on the workpiece shifts radially inwardly so that the bending arm or lever is less and a greater force is required to move the bending member. In addition, there may be a tendency for the force to be concentrated on less than the total area of the compensator.

Among the objectives of the present invention an to provide a portable sheet metal bending brake which includes an improved floating compensator which remains in contact with a greater area than the compensator of U.S. Pat. Nos. 3,481,174 and 3,482,427; which requires a lesser force to move the bending member, especially when the workpiece is bent to greater angles; and which permits a second and tighter bend to be performed without clamping the workpiece.

In accordance with the invention, the hinged bending member is provided with a floating compensator that comprises a compensator member pivoted to the bending member and a workpiece engaging pad pivot to the compensator member. As the bending member is swung to bend a workpiece, the pad engages the surface of the workpiece and remains in contact with the workpiece at the same area by the relative pivotal action of the bending member, the compensator member and the pad.

DESCRIPTION

Figure 1:
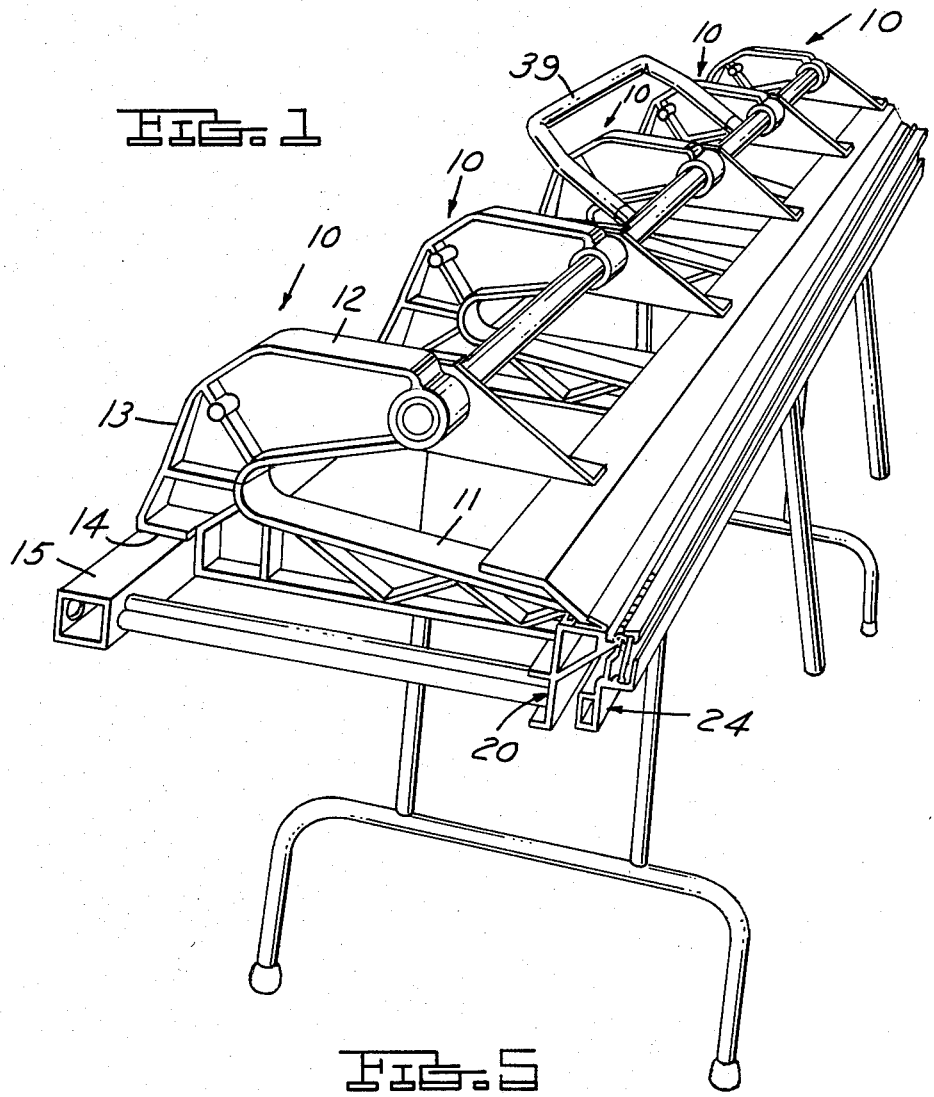
FIG. 1 is a perspective view of a portable sheet bending brake embodying the invention.
Figure 2:
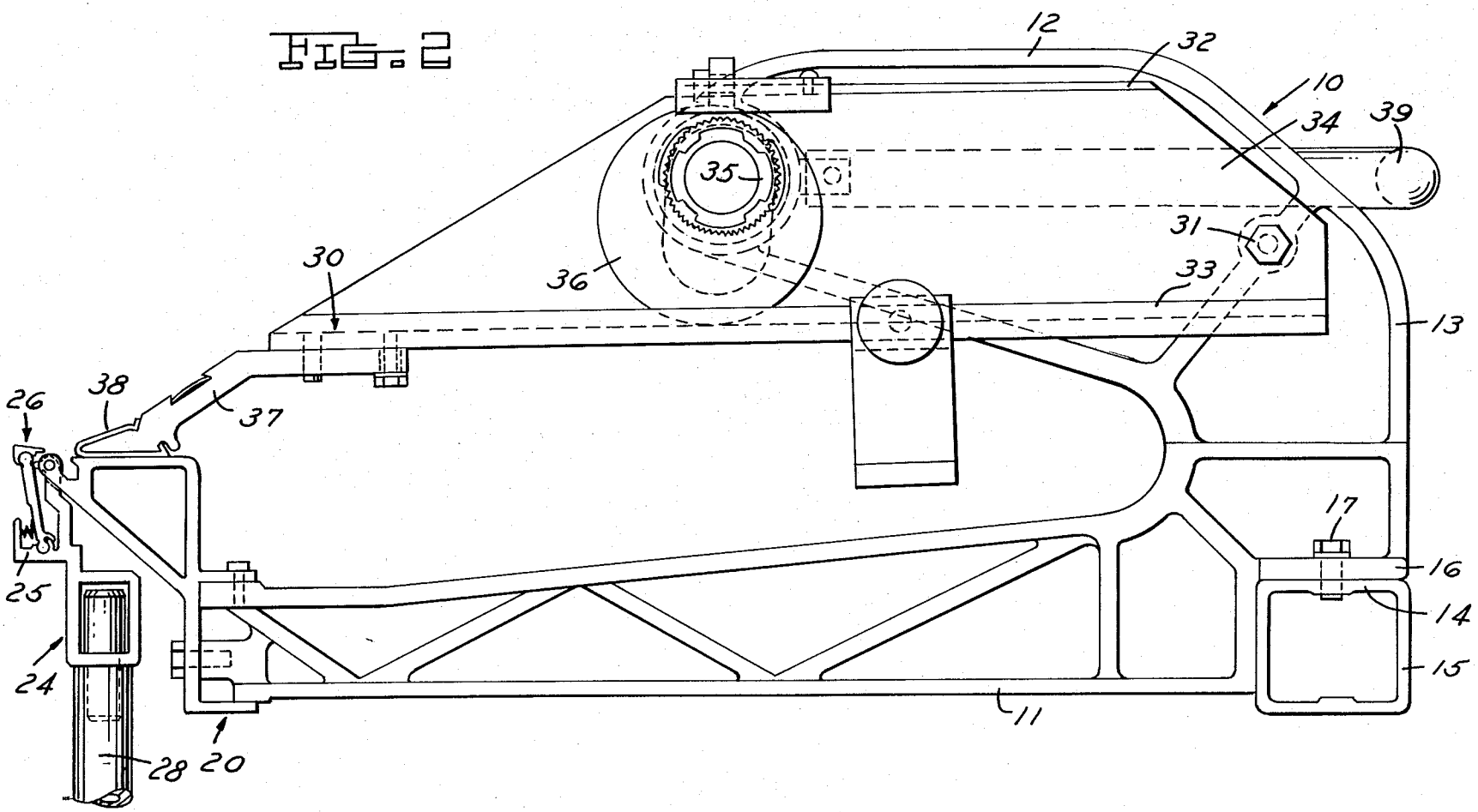
FIG. 2 is a fragmentary part sectional side elevational view.
Figure 3:
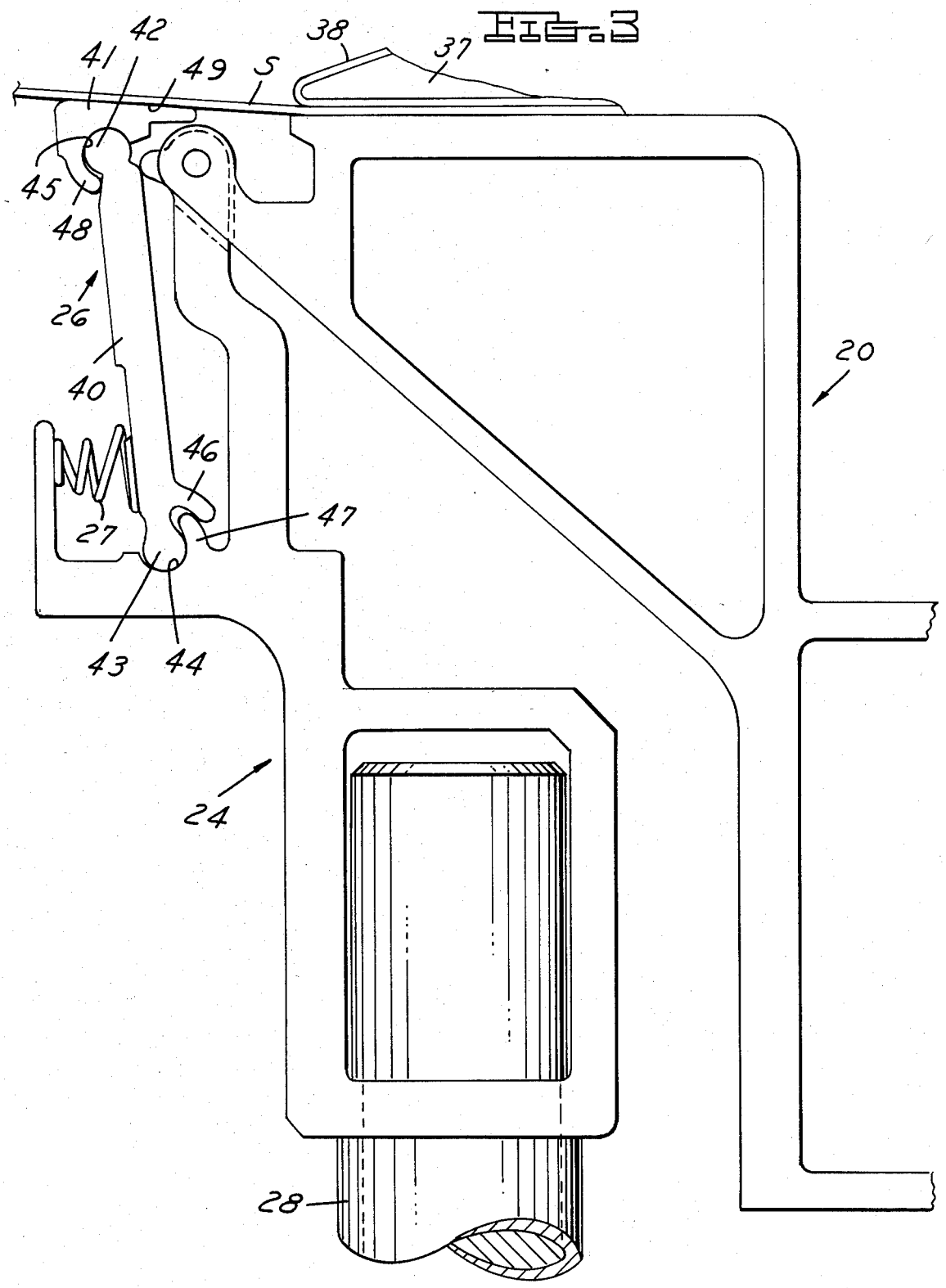
FIG. 3 is a fragmentary side elevational view on an enlarged scale of a portion of the portable sheet bending brake.

Referring to FIGS. 1, 2 and 3, the portable sheet bending brake embodying the invention comprises a plurality of longitudinally spaced C-shaped frame members 10 which are made of metal such as cast aluminum or injection molded of reinforced plastic such as 30% glass filled nylon. Each frame member 10 includes a lower arm 11 and an upper arm 12 with a connecting portion 13, the upper arm 12 being shorter than the lower arm 11. Each frame member 10 includes a rearwardly extending recess or notch 14 for receiving an extruded aluminum square rear rail 15. As shown in FIG. 2, portion 13 includes laterally extending flanges 16 overlying the upper surface of the rear rail 15 through which screws 17 extend to fasten the rear rail 15 to the frame members.

A first fixed extruded aluminum member 20 is provided on the front end of the lower arms 11 as presently described and comprises an upper generally triangular portion 21 defining a horizontal clamping surface 22 and a lower C-shaped portion 23 that has upper and lower walls that telescope over the free ends of the lower arms 11. Screws fasten the fixed member 20 on the arms 11.

An extruded aluminum bending member 24 is hinged to a portion of the fixed member 20 by a continuous hinge defined by intermeshing projections on the members 24, 20, respectively. A hinge pin extends through aligned openings in the projections to complete the hinge. The bending member 24 further includes a laterally extending L-shaped portion 25 that receives the lower end of an extruded floating compensator 26 yieldingly urged by a spring 27 against the hinge. The member 26 engages the sheet to be bent and minimizes marring during the bending as more fully described in U.S. Pat. Nos. 3,481,174 and 3,482,427 which are incorporated herein by reference. The bending member 24 further includes a tubular operating handle 28.

The sheet bending brake further includes a plurality of extruded aluminum bars 30, a bar 30 being pivoted to each frame member 10 by a bolt 31 at the area of juncture of the rear of the arm 12 and the upper part of the connecting portion 13. Each bar 30 includes an upper flange 32, a lower flange 33, and a vertical wall 34. An extruded aluminum shaft 35 is journalled in the forward ends of the upper arms 12 by plastic bearings and extend through enlarged openings in the vertical walls of the bars 30. A plurality of plastic eccentric cams 36 are fixed on shaft 35 so that they are positioned between the upper and lower flanges 32, 33 of each bar.

The bars 30 support an anvil member 37 that includes an upper horizontal portion bolted to the lower flange 33 of the bars, and inclined portion and a V-shaped nose portion having a horizontal bottom surface and an inclined upper surface. As shown in FIG. 2, a protective strip 38 of sheet metal such as rolled stainless steel is provided.

The shaft and eccentric cams are rotatably adjustable relative to one another. More specifically, the shaft and eccentric cams are provided with circumferentially spaced teeth extending axially so that the cams are locked in any adjusted position. The position of a cam can be adjusted by moving the cam axially relative to the shaft to disengage the teeth on the cam from the teeth on the shaft, rotating the cam to the desired adjusted position and moving the cam axially to reengage the teeth.

The sheet bending brake heretofore described is substantially like that described in the aforementioned U.S. application Ser. No. 423,459 filed Sept. 24, 1982, which is incorporated herein by reference.

The floating compensator 26 comprises a compensator member 40 pivoted to the bending member 24 and a workpiece engaging pad 41 pivoted to the compensator member 40. Compensator member 40 and pad 41 extend longitudinally throughout the length of the bending member 24 and fixed member 20. As the bending member 24 is swung to bend a workpiece S, the pad 41 engages the surface of the workpiece and remains in contact with the workpiece at the same area by the relative pivotal action of the bending member 24, the compensator member 40 and the pad 41.

More specifically, the compensator member 40 comprises an extrusion, the upper and lower ends 42, 43 of which are formed with arcuate cylindrically shaped surfaces, respectively. The lower end 42 engages an upwardly facing cylindrical recess 44 in the bending member 24. The upper end 43 engages a cylindrical recess 45 in the pad 41. Compensator member 40 further includes a retaining lip 46 that cooperates with a lip 47 on the bending member 24. Similarly, pad 41 includes a lip 48 that normally contacts compensator member 40 when the compensator pad is out of contact with the workpiece. The upper surface 49 of pad 41 is flat to provide maximum contact with the workpiece.

As shown in FIG. 2, before engagement with the workpiece, the upper surface 49 of pad 41 is inclined with respect to the clamped workpiece so that there is full contact by pivoting action of the pad when it engages the workpiece.

Figure 4:
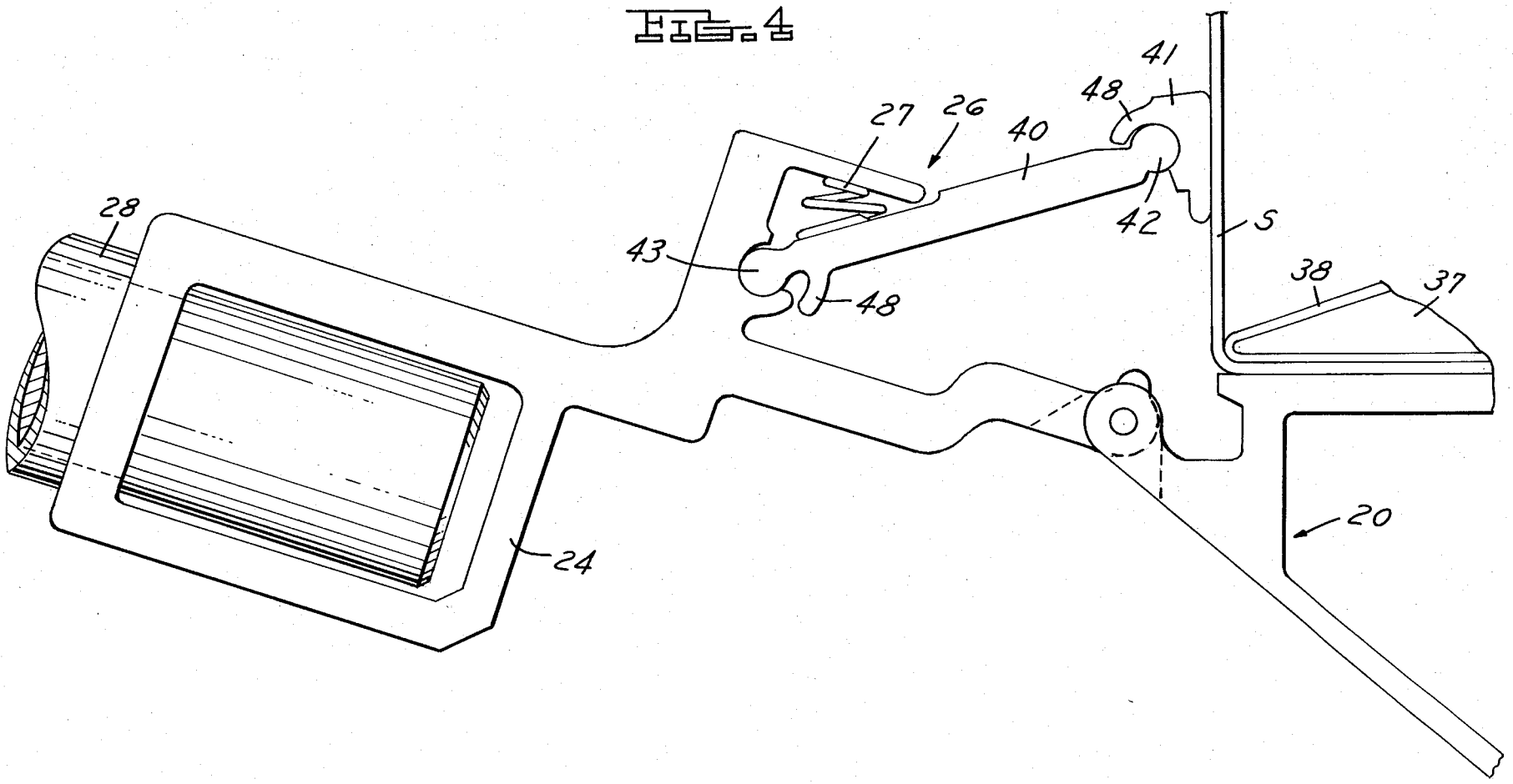
FIG. 4 is a fragmentary view similar to FIG. 3 showing the parts in a different operative position.

After a workpiece has been clamped in position for bending by swinging handle 40, the handle 28 is used to swing the bending member 24 to bend the workpiece. The pad 41 engages the workpiece and remains in contact with the entire portion of the same area of the workpiece during the entire bending operation, FIG. 4. This is assured due to the relative pivotal action of the bending member 24, compensator member 40 and pad 41.

Figure 5:
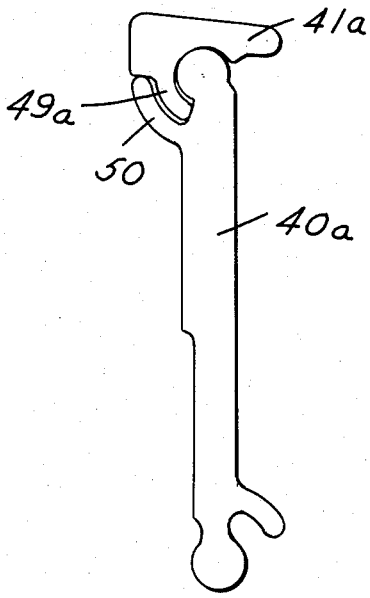
FIG. 5 is a side view of a modified portion of a portable sheet bending brake.

In the modified compensator 26*a* shown in FIG. 5, the compensator member 40*a* is provided with a lop 50 which cooperates with lip 49*a* on pad 41*a* to assist in the retention of pad 41*a* on the compensator member 40*a*.

The compensator 26 embodying the invention permits making a tighter bend after the first bend. Thus, if the workpiece is bent so that the bent portion contacts the upper surface of strip 38, the bent workpiece can be unclamped and laid on the upper surface of strip 38. The bending member is then moved to bring pad 41 into engagement with the workpiece further bending the workpiece to provide two substantially parallel contacting portions.

I claim:

1. A portable sheet bending brake comprising a fixed member defining a clamping surface extending longitudinally, a second bending member extending longitudinally, means hinging said bending member to said fixed member, an anvil member extending longitudinally of said sheet bending brake, means for moving a said anvil member into and out of clamping position with said fixed member so that a workpiece can be clamped between said anvil and fixed member, a floating compensator comprising a compensator member pivoted solely to the bending member and a workpiece engaging pad pivoted solely to the compensator member and comprising the sole contact with the surface of the workpiece such that as the bending member is swung to bend a workpiece, the pad engages the surface of the workpiece and remains in contact with the workpiece at the same area by the relative pivotal action of the bending member, the compensator member and the pad.

2. The portable sheet bending brake set forth in claim 1 wherein said work engaging pad includes a flat work contacting surface that remains in engagement with the workpiece during bending.

3. The portable sheet bending brake set forth in claim 2 wherein said bending member has a longitudinally extending recess pivotally receiving said compensator member.

4. A portable sheet bending brake set forth in claim 3 wherein said work engaging pad includes a recess pivotally receiving said compensator member.

5. The portable sheet bending brake set forth in claim 1 wherein the contacting surface of the pad forms an angle to the surface of a flat workpiece before engagement therewith.

6. The portable sheet bending brake set forth in claim 1 wherein said pad and said compensator member have interengaging means which retain said pad in a position such that the contacting surface of said pad is inclined at an angle to the surface of a flat workpiece prior to engagement therewith.

7. The portable sheet bending member set forth in claim 1 including spring means interposed between said compensator member and said bending member yieldingly urging said compensator member away from said hinging means.

* * * * *